US007549841B1

(12) United States Patent
Marussich

(10) Patent No.: US 7,549,841 B1
(45) Date of Patent: Jun. 23, 2009

(54) PRESSURE BALANCED CENTRIFUGAL TIP SEAL

(75) Inventor: Walter Marussich, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 432 days.

(21) Appl. No.: 11/514,814

(22) Filed: Sep. 1, 2006

Related U.S. Application Data

(60) Provisional application No. 60/714,212, filed on Sep. 3, 2005.

(51) Int. Cl.
*F01D 11/12* (2006.01)

(52) U.S. Cl. ..... 415/173.3; 415/174.2; 416/146 R; 416/224

(58) Field of Classification Search ..... 415/173.3, 415/174.2; 416/146 R, 228, 231 B, 240
See application file for complete search history.

(56) References Cited

U.S. PATENT DOCUMENTS

| | | | | |
|---|---|---|---|---|
| 2,314,289 | A | 3/1943 | Salisbury | |
| 2,927,724 | A | 3/1960 | Wardle | |
| 3,680,977 | A | 8/1972 | Rabouyt et al. | |
| 5,628,622 | A * | 5/1997 | Thore et al. | 416/241 R |
| 5,653,579 | A | 8/1997 | Glezer et al. | |
| 6,161,836 | A | 12/2000 | Zhou | |
| 6,206,642 | B1 * | 3/2001 | Matheny et al. | 416/230 |
| 6,439,844 | B1 | 8/2002 | Turnquist et al. | |
| 6,637,751 | B2 | 10/2003 | Asit et al. | |
| 6,736,597 | B2 | 5/2004 | Uhara et al. | |
| 6,926,495 | B2 * | 8/2005 | Diakunchak | 415/173.3 |
| 6,939,104 | B2 | 9/2005 | Chantal et al. | |
| 6,966,755 | B2 * | 11/2005 | Garner | 416/87 |

* cited by examiner

*Primary Examiner*—Ninh H Nguyen
(74) *Attorney, Agent, or Firm*—John Ryznic

(57) ABSTRACT

A turbomachine having a rotor blade with a tip seal formed between the blade tip and the shroud, where the tip seal is formed by a thin metal plate extending from the blade tip and bending away from the direction of rotation of the blade such that a flat surface of the thin metal plate floats against the shroud surface by a cushion of air formed due to the rotation. The tip seal is forced against the shroud surface due to centrifugal force from rotation so that the tip seals maintain a seal even in cases of high eccentricity. Because of the cushion of air formed from rotation, the tip seal does not wear from rubbing. The flexible plate tip seal is formed from a material such as titanium for use in a compressor, or from a high temperature resistant metal alloy such as Inco 625 for use in a turbine of a gas turbine engine.

13 Claims, 1 Drawing Sheet

PRESSURE BALANCED CENTRIFUGAL TIP SEAL

CROSS-REFERENCE TO RELATED APPLICATIONS

This application claims the benefits to an earlier filed U.S. Provisional application 60/714,212 filed on Sep. 3, 2005 and entitled PRESSURE BALANCED CENTRIFUGAL TIP SEAL.

BACKGROUND OF THE INVENTION

1. Field of the Invention

The present invention relates to rotary kinetic fluid motors or pumps, and more specifically to a seal between a rotary blade and a stationary shroud casing.

2. Description of the Related Art Including Information Disclosed Under 37 CFR 1.97 and 1.98

In a turbomachine such as a rotary pump and compressor or a turbine, a plurality of rotor blades rotate within a casing having a shroud that forms a gap between the blade tip and the shroud. Since the rotor blades are exposed to high pressure, any gap formed between the blade tip and the shroud will allow for leakage of the fluid from a high pressure side to a lower pressure side. Leakage reduces the performance of the turbomachine.

In a turbine, the rotor blades are exposed to high temperatures as well as high pressures. Temperature variations will cause the rotor blades to thermally grow in length such that the tip spacing will change and rubbing can occur. Blade tip rubbing can result in hot sections on the blade tip and damage to the blade tip and casing or both.

Another problem in the prior art is that any eccentricity between the rotor disc and the casing will result in the gap increasing in certain locations during rotation. Larger gaps will allow for more leakage across the gap.

Labyrinth seals have been used to provide for a seal between blade tips and the shroud surface. However, labyrinth seals are not flexible and therefore rub when the gap spacing becomes negative. Brush seals have been used in turbomachine to seal rotating parts against stationary parts. However, brush seals wear because they brush tips make rubbing contact with the rotating part. As the brush seal wears, leakage increases across the seal.

U.S. Pat. No. 6,736,597 B2 issued to Uehara et al on May 18, 2004 entitled AXIS SEAL MECHANISM AND TURBINE discloses a gas turbine engine having a turbine with a plurality of stages of rotor blades and stationary vanes, where the stationary vanes includes seals on the tips that form a seal between the vane tips and the rotating shaft. The seal is formed of a plurality of planar plates inclined with respect to an acute angle and bent so as to float away from the peripheral surface of the rotating shaft (see column 6, line 60 of this patent). The Uehara patent uses thousands of these little plates to create a seal, and the plates extend from the stationary vane and therefore do not rotate with the shaft or rotor blades.

It is an object of the present invention to provide for an improved seal between a rotating blade and a stationary shroud to reduce leakage across the seal and improve efficiency of the turbomachine. It is another object of the present invention to provide for a seal that will allow for high eccentricity between the rotating part and the stationary part. It is also an object of the present invention to provide for a seal between the rotating part and the stationary part of the turbomachine that will wear less than the prior art and, therefore, improve on the life of the parts.

BRIEF SUMMARY OF THE INVENTION

A turbomachine having a rotor blade with a tip seal formed between the blade tip and the shroud, where the tip seal is formed by a thin metal plate extending from the blade tip and bending away from the direction of rotation of the blade such that a flat surface of the thin metal plate floats against the shroud surface by a cushion of air formed due to the rotation. The tip seal is forced against the shroud surface due to centrifugal force from rotation so that the tip seals maintain a seal even in cases of high eccentricity. Because of the cushion of air formed from rotation, the tip seal does not wear from rubbing. The flexible plate tip seal is formed from a material such as titanium for use in a compressor, or from a high temperature resistant metal alloy such as Inco 625 for use in a turbine of a gas turbine engine.

The floating tip seal of the present invention provides for an improved seal over the prior art brush seals since the tip seal does not wear from rubbing. The floating tip seal also provides an improved seal over the Uehara et al patent above due to the tip seal being mounted on the rotor blade which, because of the centrifugal force formed from the rotation of the blade, will allow for the floating seal to push outward against the shroud surface even under high eccentricity situations.

DETAILED DESCRIPTION OF THE INVENTION

The present invention is a rotor disc 12 having a plurality of blades 18 extending therefrom. The blades 18 include a tip that forms a gap between an inner surface of a casing or inner shroud surface 14. Each blade tip includes a curved tip seal 16 that bends in a direction of rotation of the rotor disc 12 and blades 18.

Figure 2:
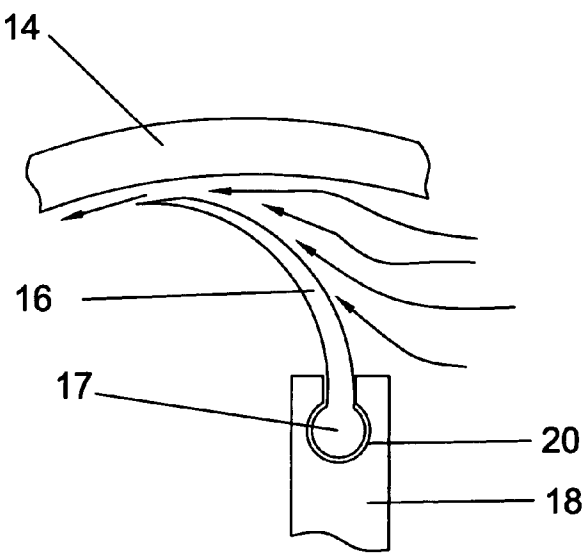
FIG. 2 shows a close-up view of an individual blade tip with a tip seal forming a seal with the casing.
Figure 1:
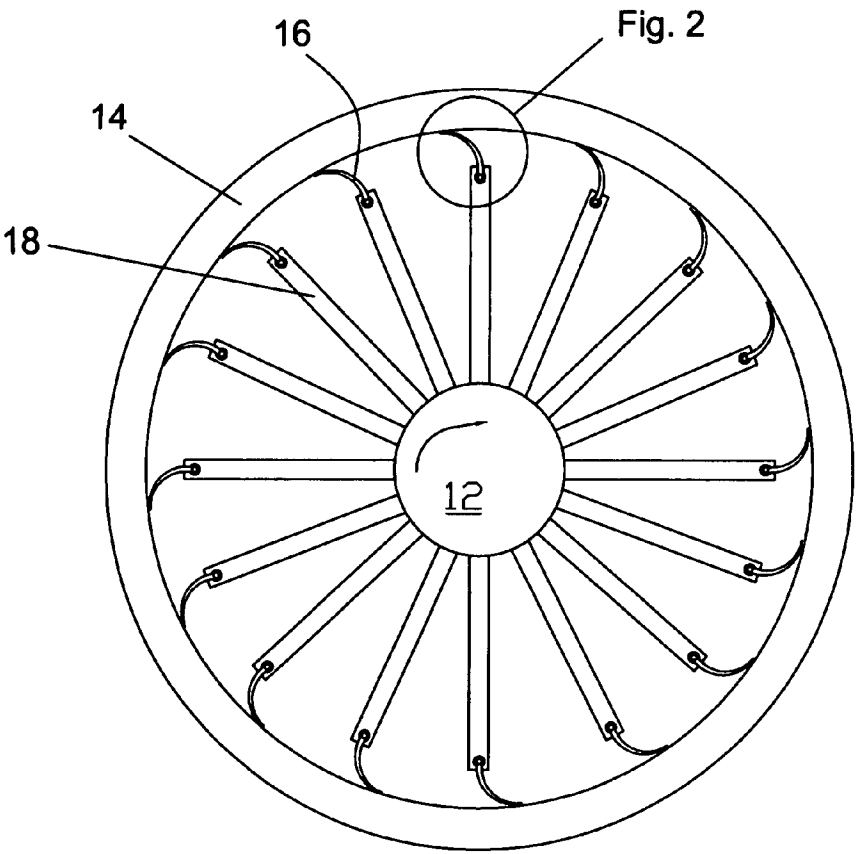
FIG. 1 shows a cross section view of a rotary disc having a plurality of blades, each blade including a tip seal in contact with an inner surface of a casing.

FIG. 2 shows a close-up view of the tip seal 16. The blade 18 includes an opening 20 in the tip in which the tip seal 16 is secured. The tip seal 16 includes a root 17 that fits within the opening 20 of the blade 18. The tip seal 16 is flexible enough to allow for the tip seal to easily bend from contact with the inner surface of the casing 14. As the rotor disc 12 and blades 18 rotate within the casing 12, the tip seals 16 will bend rearward as shown in FIG. 2, and the air ahead of the tip seal 16 (shown by arrows in FIG. 2) will build up along the upstream surface of the tip seal 16, and form a cushion of air that will pass in a gap formed between the tip seal 16 end and the casing surface 14. This cushion of air will lift the end of the tip seal 16 off of the casing surface 14 while providing a seal between the gap. As the rotor blade 18 rotates, the flexible tip seal 16 will be forced under centrifugal force to contact the inner shroud surface of the casing 12 as the flexible tip seal 16 moves along the inner shroud surface, a film, layer will be formed between the flexible tip seal surface and the inner shroud surface that will limit leakage across the blade tip and prevent wear of the flexible tip seal 16.

Rotation of the rotor disc 12 and blades 18 will provide a centrifugal force on the tip seals 16 that tend to force the tip seals 16 radially outward and up against the casing surface 14. This provides an improved seal over the Prior Art in that any eccentricity between the rotor disc 12 and the casing inner surface 14 will be offset by the flexibility of the tip seals due to the centrifugal force tending to force the tip seals into contact with the casing surface 14. Because of the air cushion developed between the tip seal 16 and the casing inner surface 14, the tip seal 16 does not rub up against the inner casing surface 14 and wear out. Therefore, the tip seal 16 will last longer, provide a better seal between a changing gap due to eccentricity between the rotor disc 12 and the casing inner surface 14, and provide a lower cost tip seal.

The tip seal 16 is made from a thin metal sheet material in which the root 17 is formed by rolling the one end of the tip seal. The tip seal 16 can also be formed from a metal extrusion. The body of the tip seal 16 is shown to have a varying thickness in FIG. 2, but can also have a constant thickness extending from the root 17 to the end of the tip. The thickness must allow for the tip seal 16 to flex within the casing and make contact with the inner casing surface to develop the air cushion effect described above. The tip seal 16 of the present invention can be used in a compressor or a turbine section of a gas turbine engine, or in a compressor which operates in a low temperature range. The material used for the tip seal 16 would have to be capable of withstanding the temperature environment in which it is used. In a hot environment, the tip seal can be made of Inco 625, while in a cold environment a suitable elastic material such as plastic can be used.

I claim:

1. A turbo machine comprising:

a rotor blade with a blade tip;

a shroud with an inner shroud surface that forms a seal with the blade tip; and, a flexible blade tip seal secured to the blade tip;

the flexible seal extending from the blade tip and being long enough so that one side of the flexible tip seal will be substantially parallel to the inner shroud surface due to centrifugal force acting on the flexible tip seal; and, the flexible tip seal being flexible enough such that a cushion of air is formed between the flexible tip seal surface and the inner shroud surface during rotation of the rotor blade.

2. The turbo machine of claim 1, and further comprising:

the flexible tip seal is a high temperature resistant material for use in a turbine of a gas turbine engine.

3. The turbo machine of claim 1, and further comprising:

the flexible tip seal is mostly titanium.

4. The turbo machine of claim 1, and further comprising:

the flexible tip seal is thinner on the outer end than on the inner end.

5. The turbo machine of claim 4, and further comprising:

the flexible tip seal is progressively thinner toward the outer end.

6. The turbo machine of claim 1, and further comprising:

the flexible tip seal includes a pressure side surface and an opposed suction side surface, and a tip formed on the end of the plate, the tip being substantially flat and substantially parallel to the shroud surface, the flat tip forming a fluid cushion with the shroud surface.

7. The turbo machine of claim 1, and further comprising:

the flexible tip seal bends against a rotational direction of the rotor blade tip.

8. A seal formed between a rotating blade and a stationary inner shroud surface, the rotating blade having a tip positioned close to the shroud but far enough away from the shroud to prevent rubbing during large eccentricity, the seal comprising:

a flexible plate extending from the blade tip and bending away from a direction of rotation of the blade to form a fluid cushion between the flexible plate and the shroud surface such that the flexible plate floats against the shroud to form a seal between the blade tip and the shroud due to centrifugal force from blade rotation and forms a fluid cushion between the flexible plate and the inner shroud surface during blade rotation.

9. The seal of claim 8, and further comprising:

the flexible plate is flexible enough such that a centrifugal force from rotation pushes the flexible plate toward the shroud to form the fluid cushion during rotation of the blade.

10. The seal of claim 8, and further comprising:

the flexible plate is formed substantially from titanium.

11. The seal of claim 8, and further comprising:

the flexible plate is made of a high temperature resistant material to allow for operation in a turbine of a gas turbine engine.

12. The seal of claim 8, and further comprising:

the flexible plate includes a pressure side surface and an opposed suction side surface, and a tip formed on the end of the plate, the tip being substantially flat and substantially parallel to the shroud surface, the flat tip forming a fluid cushion with the shroud surface.

13. The seal of claim 8, and further comprising:

the flexible plate extends from the blade tip in a direction substantially parallel to the axis of the blade, and the flexible plate bends toward the shroud surface in a direction substantially parallel to the shroud surface.

* * * * *